US007878249B2

(12) United States Patent
Lovell

(10) Patent No.: US 7,878,249 B2
(45) Date of Patent: Feb. 1, 2011

(54) COMMUNICATION SYSTEM AND METHOD IN A MULTILATERAL WELL USING AN ELECTROMAGNETIC FIELD GENERATOR

(75) Inventor: John R. Lovell, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 37 days.

(21) Appl. No.: 12/260,492

(22) Filed: Oct. 29, 2008

(65) Prior Publication Data

US 2010/0101772 A1 Apr. 29, 2010

(51) Int. Cl.
*E21B 43/14* (2006.01)

(52) U.S. Cl. ..... 166/313

(58) Field of Classification Search ..... 166/313, 166/50, 65.1

See application file for complete search history.

(56) References Cited

U.S. PATENT DOCUMENTS 5,959,547 A 9/1999 Tubel et al.
6,318,457 B1 * 11/2001 Den Boer et al. ..... 166/66.7
6,330,913 B1 12/2001 Langseth et al.
6,357,525 B1 3/2002 Langseth et al.
6,464,011 B2 * 10/2002 Tubel ..... 166/313
6,515,592 B1 2/2003 Babour et al.
6,958,704 B2 * 10/2005 Vinegar et al. ..... 340/854.3
2005/0207279 A1 * 9/2005 Chemali et al. ..... 367/83
2006/0090893 A1 5/2006 Sheffield
2006/0254767 A1 11/2006 Pabon et al.
2007/0235185 A1 10/2007 Patel et al.
2007/0295504 A1 12/2007 Patel

FOREIGN PATENT DOCUMENTS

EP 1903181 A1 3/2008
GB 2419923 A 5/2006
GB 2426053 A 11/2006
GB 2438481 A 11/2007
WO 0065200 A1 11/2000

* cited by examiner

*Primary Examiner*—William P Neuder

(57) ABSTRACT

To perform communications in a multilateral well, a first communication unit having an electromagnetic (EM) field generating element is provided to generate an EM field in a formation between a main bore and a lateral bore of the multilateral well. The EM field generating element includes a component creating a voltage difference along the wellbore. A second communication unit is for positioning in one of the main bore and lateral bore to receive the EM field propagated through the formation between the main bore and the lateral bore.

22 Claims, 4 Drawing Sheets

COMMUNICATION SYSTEM AND METHOD IN A MULTILATERAL WELL USING AN ELECTROMAGNETIC FIELD GENERATOR

BACKGROUND

1. Field of the Invention

The invention relates generally to performing communications in a multilateral well that uses an electromagnetic (EM) field generating element to generate an EM current in a formation between a main bore and a lateral bore of the multilateral well.

2. Description of the Related Art

The following descriptions and examples are not admitted to be prior art by virtue of their inclusion in this section.

Tools can be lowered into a well to perform various downhole operations. Some of the tools lowered into a well can include electrical devices, such as sensors, controllers, and so forth. Traditionally, communication with such electrical devices has been achieved using electrical cables run from an earth surface location down the well to the downhole electrical devices. However, deployment of electrical cables may not be feasible across the complete interval to the device or may be difficult in various scenarios, such as in a multilateral well that has one or more lateral bores. In such a scenario, a continuous length of electrical cable may not be possible from the main bore into the lateral bore. However, having to electrically connect discrete segments of an electrical cable downhole is difficult and usually requires that such electrical cable connection be made in the presence of liquids (i.e., such a connection may be generally referred to as a "wet connection").

To address the above issue, one possible technique of performing electrical communications downhole is by use of inductive couplers. An inductive coupler includes a first inductive coupler portion and a second inductive coupler portion that are placed in close proximity with each other. Current provided in one of the inductive coupler portions induces a corresponding current in the other inductive coupler portion, if the two inductive coupler portions are positioned in close proximity to each other. However, the requirement that inductive coupler portions have to be positioned close to each other for proper operation can increase the complexity of the downhole equipment, since the downhole equipment would have to be provided with appropriate positioning devices to ensure that inductive coupler portions are properly positioned with respect to each other so as to enable them to communicate.

SUMMARY

In general, according to an embodiment, an apparatus for performing communications in a multilateral well may include a first communication unit having an electromagnetic (EM) field generating element to generate an EM current in a formation between a main bore and a lateral bore of the multilateral well. The junction of the multilateral is constructed to focus the electromagnetic current as it passes from the main bore to the lateral. This focusing can be done by use of conductive elements such as conductive cement pumped into the vicinity of the junction. A second communication unit is positioned in one of the main bore or lateral bore to receive the EM current propagated through the formation between the main bore and the lateral bore. The EM current along the lateral creates a voltage which can be measured and which can be used to power devices in the lateral.

Other or alternative features will become apparent from the following description, from the drawings, and from the claims.

BRIEF DESCRIPTION OF THE DRAWINGS

Certain embodiments of the invention will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
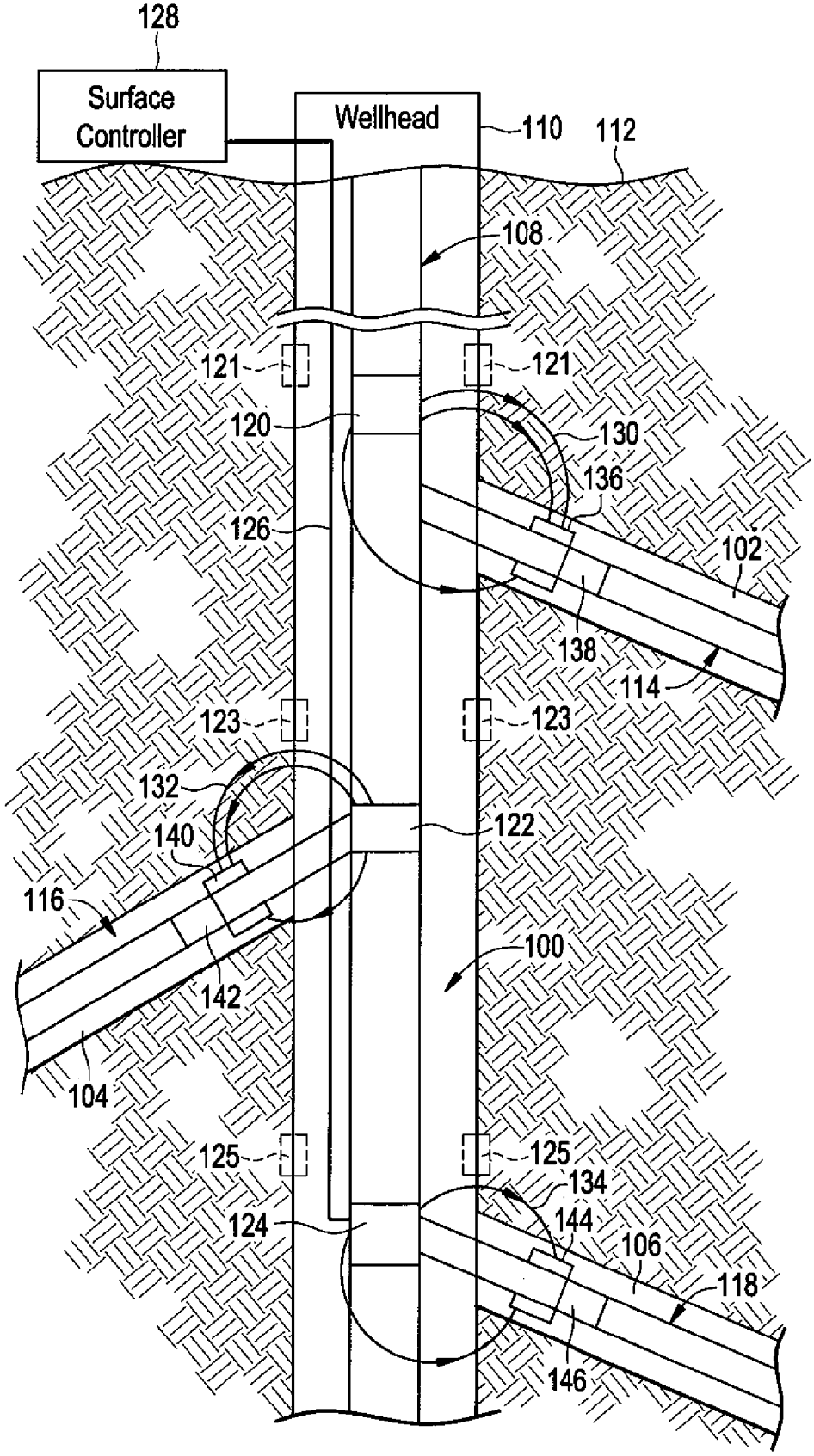
FIG. 1 illustrates an exemplary downhole arrangement that includes communication units each having an electromagnetic (EM) field generating element according to an embodiment.

FIG. 1 shows an exemplary multilateral well that has a main bore 100 and multiple lateral bores 102, 104, and 106. Although three lateral bores 102, 104, and 106 are depicted in FIG. 1, it is noted that an alternative multilateral well can include just one lateral bore, two lateral bores, or more than three lateral bores.

A tool string 108 extends from a wellhead 110 located at an earth surface 112 into the multilateral well. As depicted in the example of FIG. 1, the tool string 108 has a main section that extends in the main bore 100, and lateral sections 114, 116, and 118 that extend into lateral bores 102, 104, and 106, respectively. The tool string 108 can be a completion string to allow for production of fluids, such as hydrocarbons, fresh water, and so forth, or to perform injection of fluids, such as water, gas (e.g., carbon dioxide), and so forth. Alternatively, the tool string 108 can be used for performing logging or exploration services, drilling, or other tasks.

The tool string 108 also includes several communication units 120, 122, and 124 to allow communication between the main section of the tool string 108, and the lateral sections 114, 116, and 118 located in respective lateral bores 102, 104, and 106. The communication units 120, 122, and 124 may be connected to an electrical cable 126 that extends to the wellhead 110 (or some other location in the well). The electrical cable 126 can be electrically connected to a surface controller 128, which can be a computer or other type of controller.

Each of the communication units 120, 122, and 124 is capable of generating electromagnetic fields 130, 132, and 134, respectively, which are able to propagate through respective sections of a formation surrounding the multilateral well. For example, the EM field 130 emitted by the communication unit 120 propagates current through a formation section between the main bore 100 and the lateral bore 102. A receiver 136 that is part of the lateral section 114 in the lateral bore 102 may be configured to detect a portion of the EM current 130 emitted by the communication unit 120 that propagates through the formation section. The receiver 136 is an EM receiver that can be connected to an electrical module 138 that is part of the lateral section 114. The electrical module 138 may be configured to respond to the detected EM current 130 to perform tasks in the lateral bore 102. The electrical receiver 136 can be a cable that is deployed along the lateral branch. That cable will be electrically insulated from the metallic completion components along the wellbore and will sense the voltage difference between one component of the lateral and another component provided at a significant distanced along the lateral.

Similarly, the EM current 132 generated by the communication unit 122 is detectable by a receiver 140 that is part of the lateral section 116 in the lateral bore 104. The EM receiver 140 may be coupled to an electrical module 142. In addition, an EM receiver 144 that is part of the lateral section 118 in the lateral bore 106 is able to detect the EM current 134. The EM current 134 may be generated by the communication unit 124 and propagated through the formation section between the main bore 100 and the lateral bore 106.

The EM receivers 136, 140, and 144 can include electric field sensing elements and/or magnetic field sensing elements. The electrical modules 138, 142, and 146 can be sensors, control modules, and so forth.

Instead of the communication units 120, 122, 124 generating EM currents 130, 132, 134 for receipt by receivers 136, 140, and 144, the receivers can be substituted with EM transmitters that are able to produce the EM currents 130, 132, 134 for receipt by the communication units 120, 122, and 124. More generally, the receivers 136, 140, and 144 can be replaced with "lateral communication units" that are able to transmit and/or receive EM fields. The communication units 120, 122, and 124, coupled to the main section of the tool string 108, can also be referred to as "main communication units."

By using main communication units, 120, 122, and 124, which are configured to communicate using EM fields 130, 132, and 134, through formation sections with lateral communication units in the corresponding lateral bores 102, 104, and 106, a system is established in which a relatively simple technique allows communication between the main section of the tool string 108 and the lateral sections 114, 116, and 118, of the tool string 108. Exact relative positioning of the main communication units 120, 122, and 124 and lateral communication units is not required since the communications performed using the communication units 120, 122, and 124, rely on EM currents 130, 132, and 134 that are propagated through the various formation sections.

Although the main communication units 120, 122, and 124 are depicted as being mounted on the tool string 108, note that the main communication units can alternatively be mounted with a casing or liner that lines the main bore 100 (as indicated by dashed profiles 121, 123, and 125). Similarly, the lateral communication units 136, 140, and 144 can also be part of the liner for respective lateral bores 102, 104, and 106.

Figure 2:
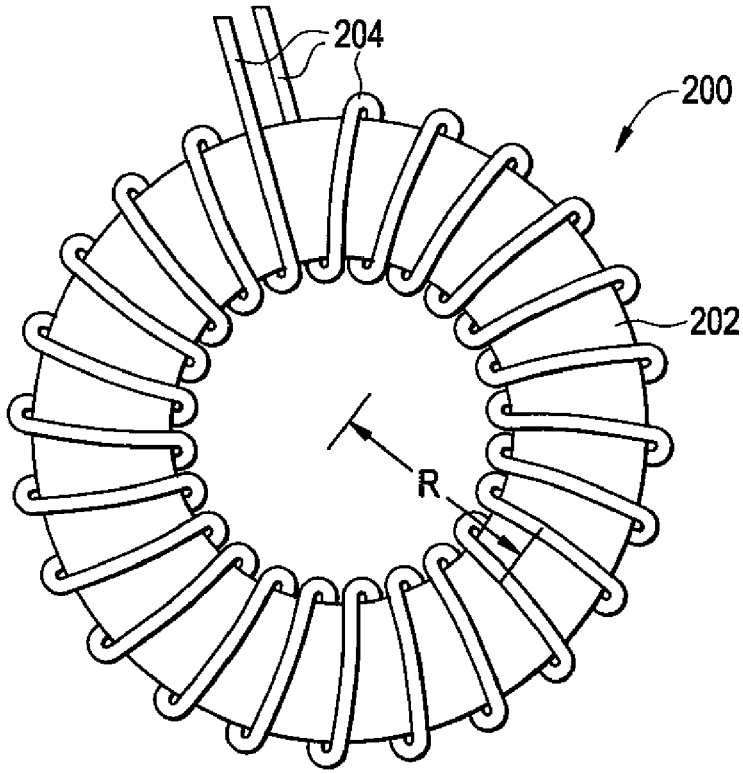
FIG. 2 illustrates an exemplary toroidal communication element that can be used as the EM field generating element of FIG. 1, according to an embodiment.

In one embodiment, at least one of the main communication units, 120, 122, and 124 can include a toroidal communication element 200, as depicted in FIG. 2. The toroidal communication element 200 may include a ring-shaped core 202 formed of a relatively high magnetic permeability material. In addition, an electrical wire 204 is wrapped around the ring-shaped core 202. A time-varying electrical current is run through the wire 204, which induces an EM current that propagates through a corresponding formation section, as depicted in FIG. 1. The toroidal communication element 200 is generally arranged as a loop having a radius R. Note that one or more of the lateral communication units 136, 140, and 144 can also be implemented with a toroidal communication element.

Figure 3:
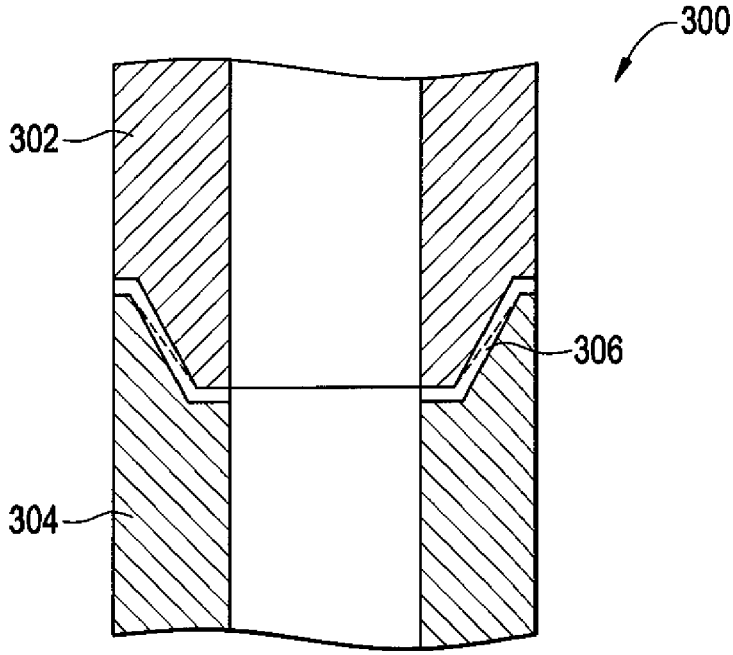
FIG. 3 illustrates a voltage gap element that can be used as the EM field generating element of FIG. 1, according to another embodiment.

Alternatively, at least one of the main communication units 120, 122, and 124 (or lateral communication units 136, 140, and 144) can employ a voltage gap element, such as the voltage gap element 300 depicted in FIG. 3. The voltage gap element 300 may include a first electrically conductive member 302 and a second electrically conductive member 304 that are separated by an electrically insulating member 306. The electrically insulating member 306 can be coated onto threads or other mating surfaces of one or both of the electrically conductive members 302 and 304. When the electrically conductive members 302 and 304 are connected together, the electrically conductive members 302 and 304 are electrically separated by the insulating layer 306.

The combination of the electrically conductive members 302 and 304, which are separated by the insulating layer 306, effectively comprise a capacitive element. A voltage difference can be established across the electrically conductive members 302 and 304 via the insulating layer 306. An electromagnetic field may develop between the electrically conductive members 302 and 304 in situations in which a time-varying voltage is applied. This electromagnetic field causes a time-varying current to be generated in a region surrounding the voltage gap communication element 300. The generated EM current can be one of the EM currents 130, 132, and 134 depicted in FIG. 1. In a preferred embodiment the time-variation may be sinusoidal so that the variation in time is of one or more predetermined frequencies. Changing the frequency may then provide a method of communication between the main bore and the voltage receivers located elsewhere in the well. Other communication protocols are well known in the industry (e.g., phase-shift keying, quadrature amplitude modulation, etc).

Instead of providing an insulating layer 306 onto a thread or mating surface of an electrically conductive member 302 and/or 304, an alternative embodiment can employ other arrangements of two electrically conductive members and a separate insulating layer therebetween (e.g., two electrically conductive plates separated by an insulating layer, etc.).

Figure 4C:
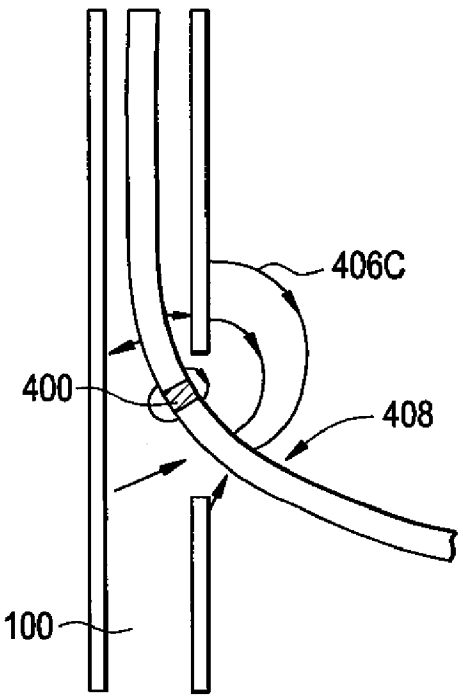
FIGS. 4A-4C illustrate various possible positions of the communication unit of FIG. 1, according to some embodiments, in a multilateral well.
Figure 4B:
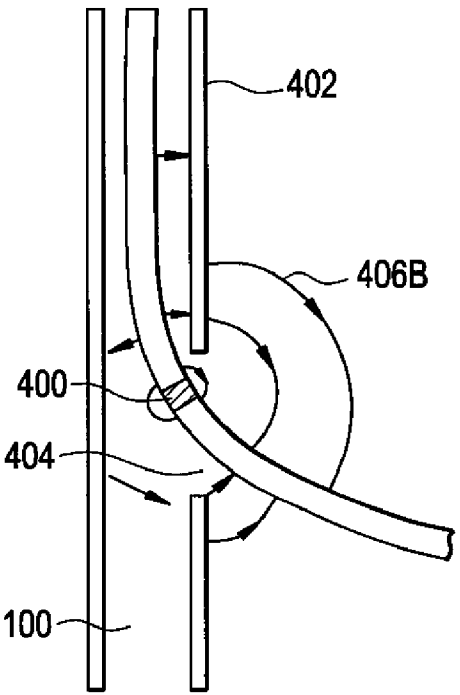
Figure 4A:
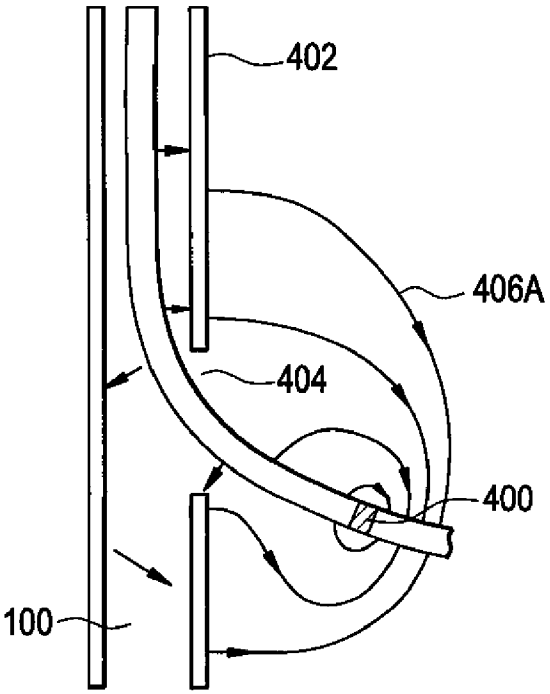

FIGS. 4A-4C show the variations in EM currents produced by a communication unit 400 (which can be any of the communication units 120, 122, 124, 136, 140, and 144 of FIG. 1), with respect to the position of the communication unit 400 relative to the casing 402 that lines the main bore 100. As depicted in FIG. 4A, when the communication unit 400 is positioned outside a lateral window 404 of the casing 402 in a lateral bore, an EM current 406A may be generated. If the communication unit 400 is located inside the main bore 100 but close to the window 404, then EM current 406B may be generated, as depicted in FIG. 4B. Note that the EM current 406B of FIG. 4B is reduced when compared to the EM current 406A of FIG. 4A.

FIG. 4C shows an EM current 406C produced by the communication unit 400 (occupying the same relative position as the communication unit 400 of FIG. 4B), when there is a break in conductivity of a tool string, as indicated by 408 in FIG. 4C. The conductivity break 408 causes a further reduction in an EM current 406C as compared to the EM current 406B.

To further enhance efficiency of transmission, conductive cement (e.g., for cementing casing or liner to the wellbore) can be provided near the junction between the main bore and lateral bore. Conventional cement is known to be an electrical insulator. The addition of conductive particulate and fibrous materials to cement can significantly reduce the resistivity values. Fluid filled porosity can also lower the effective resistivity of the cement in situations in which the fluid is conductive and the cement highly porous. However, highly porous cement would not be appropriate with regards to sealing the junction. Accordingly, a preferred embodiment is to use conductive cement with appropriate conductive fibers added to the mix. Such cements have been described in co-pending U.S. application Ser. No. 11/947,881; "CONDUCTIVE CEMENT FORMULATIONS FOR OIL AND GAS WELLS" filed Nov. 30, 2007, by R. Williams, et al, whose contents are hereby incorporated by reference.

Alternatively, the use of metallic materials in the lateral section can help focus the EM current and enhance transmission, for example, such as passing continuous metal tubing from the main bore to the lateral. The tubing may be configured to establish electrical contact with a liner deployed into the lateral. However, in order to get significant current focusing, the tubing needs to be of significantly longer extent in the lateral direction as compared to the well diameter. For example, in a preferred embodiment the metal tubular will be longer than 10 ft when used in a well with a diameter of 6".

Figure 5A:
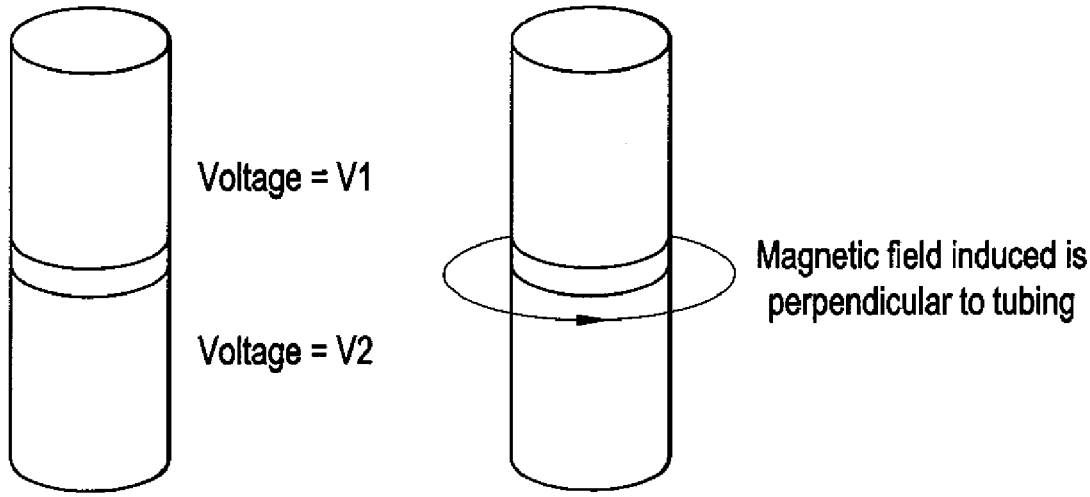
FIGS. 5A-5B illustrates a magnetic field induced by a voltage gap in the case of a magnetic field perpendicular to the main bore and the case of a magnetic field that will be largely perpendicular to a lateral bore.
Figure 5B:
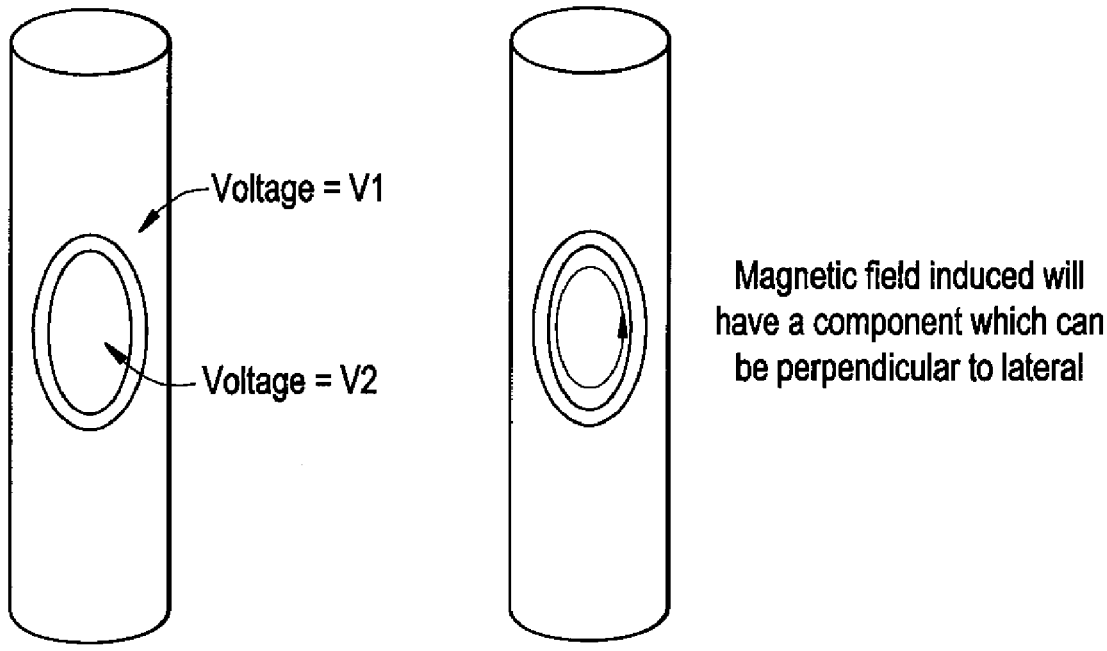

A voltage gap in the casing may induce a current in the formation. In the cases in which the current varies with time, the voltage gap induces a corresponding time-varying magnetic field according to Ampere's law. In the cases in which the voltage gap is due to a coated thread on the casing, then the magnetic field will be largely azimuthal around the casing. As shown in FIGS. 4A-4C, such a configuration is non-optimal. A larger voltage potential will be induced along the lateral bore in situations in which the magnetic field is perpendicular to the lateral bore. FIG. 5A shows an induced magnetic field due to a situation such as a voltage gap due to a coated thread on the casing. FIG. 5B shows an induced magnetic field in which there is a component substantially perpendicular to the lateral.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. An apparatus for performing communication in a multilateral well, comprising:

a first communication unit having an electromagnetic (EM) field generating element to generate a first voltage potential along a section of the main bore of a multilateral well, and a second communication unit for positioning in a lateral bore of the multilateral well to measure a second voltage potential induced along a section of the lateral bore, wherein the first voltage potential is varied in time to create an electromagnetic field which generates a time-varying electrical current in the rock formation between the main bore and the lateral bore, and wherein the junction between the main bore and the lateral well has a component which is of higher electrical conductivity than the surrounding rock formation.

2. The apparatus of claim 1, wherein the conductive component is conductive cement.

3. The apparatus of claim 1, wherein the conductive component is a metallic tubular of axial extent significantly greater than the wellbore diameter.

4. The apparatus of claim 3, wherein the metallic tubular is used to convey fluids from the lateral into the main bore.

5. The apparatus of claim 1, further comprising a tool string positioned in the main bore, wherein the first communication unit is part of the tool string, and wherein the second communication unit is for positioning in the lateral bore.

6. The apparatus of claim 1, further comprising a casing to line the main bore, wherein the first communication unit is attached to the casing and wherein the first voltage potential is induced on the casing.

7. The apparatus of claim 1, further comprising an electrical cable connected to the first communication unit, wherein the electrical cable is to extend to the wellhead.

8. The apparatus of claim 1, wherein the EM field generating element is a voltage gap element, and wherein the voltage gap element has electrically conductive members separated by an electrically insulating layer.

9. The apparatus of claim 8, wherein the electrically insulating layer is provided on a thread of at least one of the electrically conductive members, and wherein the electrically conductive members are threadably connected together.

10. The apparatus of claim 8, wherein the voltage gap creates a magnetic field which is largely perpendicular to the main bore.

11. The apparatus of claim 8, wherein the voltage gap creates a magnetic field which is largely perpendicular to the lateral bore.

12. A method of performing communications in a multilateral well, comprising:

providing a first communication unit in a main bore of the multilateral well, wherein the first communication unit has an electromagnetic (EM) field generating element to generate an EM current in a formation section between the main bore and a lateral bore of the multilateral well, wherein the EM field generating element comprises a voltage gap element; and providing a second communication unit in the lateral bore to receive a component of the EM current propagated through the formation section between the main bore and the lateral bore.

13. The method of claim 12, wherein the second communication unit has an EM field generating element that comprises a voltage gap element, the method further comprising:

the second communication unit generating an EM field in the formation section between the main bore and the lateral bore for receipt by the first communication unit.

14. The method of claim 12, further comprising positioning the first communication unit proximate a window of a casing that allows for access between the main bore and the lateral bore.

15. The method of claim 12, further comprising providing an electrical module in the lateral bore, wherein the electrical module is connected to the second communication unit.

16. The method of claim 12, wherein the electrical module comprises a sensor.

17. The method of claim 12, wherein the multilateral well further comprises another lateral bore, the method further comprising:

providing a third communication unit in the main bore of the multilateral well, wherein the third communication unit has an EM field generating element to generate an EM current in a formation section between the main bore and the another lateral bore of the multilateral well, wherein the EM field generating element comprises a voltage gap element; and providing a fourth communication unit in the lateral bore to receive a component of the EM current propagated through the formation section between the main bore and the another lateral bore.

18. A system for use with a multilateral well, comprising:

a casing for lining a main bore of the multilateral well;

a main communication unit mounted with the casing;

metallic tubulars in the lateral bores of the multilateral well;

lateral communication units for positioning in lateral bores of the multilateral well, wherein each of the main communication units is arranged to communicate with a corresponding one of the lateral communication units using an EM current propagated through a formation section between the main bore and the corresponding one of the lateral bores, wherein at least one of the main communication units and lateral communication units comprises an electromagnetic (EM) field generating element comprising a voltage gap element.

19. The system of claim 18, wherein the EM field generating element is a toroidal element, and wherein the toroidal element has a ring-shaped core of high magnetic permeability, and a wire wrapped around the ring-shaped core.

20. The system of claim 18, wherein the EM field generating element is the voltage gap element, and wherein the voltage gap element has electrically conductive members separated by an electrically insulating layer.

21. The system of claim 18, wherein the EM field generating element creates a magnetic field which is largely perpendicular to the main bore.

22. The system of claim 18, wherein the EM field generating element creates a magnetic field which is largely perpendicular to the lateral bore.

* * * * *